US007198073B2

(12) United States Patent
Luehrsen et al.

(10) Patent No.: US 7,198,073 B2
(45) Date of Patent: Apr. 3, 2007

(54) METHODOLOGY AND APPARATUS FOR STORING AND DISPENSING LIQUID COMPONENTS TO CREATE CUSTOM FORMULATIONS

(75) Inventors: Robert A. Luehrsen, Libertyville, IL (US); Derek P. Pedraza, Ingleside, IL (US); John Borkovec, Libertyville, IL (US)

(73) Assignee: GFI, Innovations, Libertyville, IL (US)

( * ) Notice: Subject to any disclaimer, the term of this patent is extended or adjusted under 35 U.S.C. 154(b) by 0 days.

(21) Appl. No.: 10/628,320

(22) Filed: Jul. 28, 2003

(65) Prior Publication Data

US 2004/0216804 A1 Nov. 4, 2004

Related U.S. Application Data

(60) Provisional application No. 60/398,882, filed on Jul. 26, 2002, provisional application No. 60/456,746, filed on Mar. 21, 2003.

(51) Int. Cl.
*B65B 1/04* (2006.01)

(52) U.S. Cl. ..... 141/94; 141/301; 222/94; 222/212

(58) Field of Classification Search ..... 141/10, 141/105–107, 146, 258, 261, 94, 96, 83, 141/301; 222/92, 95, 212, 214, 213, 494
See application file for complete search history.

(56) References Cited

U.S. PATENT DOCUMENTS 2,684,008 A * 7/1954 Vonnegut ..... 356/37
3,534,520 A * 10/1970 Moran ..... 53/416
3,874,430 A * 4/1975 Lansdale ..... 141/116
4,193,513 A * 3/1980 Bull, Jr. ..... 222/1
4,231,492 A * 11/1980 Rios ..... 222/1
4,280,637 A * 7/1981 Runciman ..... 222/39
4,796,788 A * 1/1989 Bond ..... 222/94
4,928,853 A * 5/1990 Isham et al. ..... 222/108
5,083,591 A * 1/1992 Edwards et al. ..... 141/9
5,129,551 A * 7/1992 Gott ..... 222/135
5,246,674 A * 9/1993 Katschnig et al. ..... 422/302
5,559,339 A * 9/1996 Domanik et al. ..... 250/573
5,904,334 A * 5/1999 Grunert et al. ..... 251/120
6,056,158 A * 5/2000 Rossetti et al. ..... 222/95
6,131,766 A * 10/2000 King et al. ..... 222/1
6,405,901 B1 * 6/2002 Schantz et al. ..... 222/213

* cited by examiner

*Primary Examiner*—Steven O. Douglas
(74) *Attorney, Agent, or Firm*—Banner & Witcoff, Ltd.

(57) ABSTRACT

A methodology and apparatus comprises integral material reservoir cylinders which contain separate material bags in which reside a component required for a formulation, or alternate material reservoir containers, typically drums, with a component required for a formulation in each drum, or a combination of both, that provides a volume of material through a supply tube into a valve that directs the material to either: 1) a dispense tube and through a dispense valve, into a receiving container that sits upon a scale, or 2) into a dispense cylinder in which resides a piston that, through the use of a piston drive plate actuator and the piston drive plate actuators' piston drive plate, directs the material through a valve and through a dispenser tube and through a dispense valve and into a receiving container that sits upon a scale.

24 Claims, 3 Drawing Sheets

METHODOLOGY AND APPARATUS FOR STORING AND DISPENSING LIQUID COMPONENTS TO CREATE CUSTOM FORMULATIONS

BACKGROUND OF THE INVENTION

This application claims priority to U.S. Provisional Application Ser. No. 60/398,882, filed Jul. 26, 2002, and U.S. Provisional Application 60/456,746 filed Mar. 21, 2003, which are incorporated herein by reference in their entirety.

The present invention relates to dispensing a specific amount of material from one container into another container.

There are many different types of material dispensers available to the market offering differing levels of automation, each of which tends to be designated to dispensing a specific material, often defined by the substance composition of the material being dispensed and the viscosity of the material. A machine dispensing material low in viscosity would likely be different in both methodology and apparatus from that of a machine dispensing a paste material.

Materials are typically stored and transported by using a number of different containers. Among the most common are steel drums (55 and 30 gallon capacities), HDPE buckets (5, 3-½ and 2 gallon capacities), HDPE jugs (1 gallon capacity), cardboard (known in the ink industry as "Sonoco" cartridges) or plastic tubes, and metal cans (of 1 and 2 quart capacities).

Dispensing equipment is seen in virtually every industry requiring a finished product that is created from a formulation. Formulations are often seen in the paint, ink, cosmetics, pharmaceutical, foodservice and chemicals industries. For instance, in the ink industry, a printer may need custom color ink created to satisfy the requirements of a particular project. The finished product is created using a formulation, or a recipe of materials. In the paint industry a formulation is required to create a custom color of paint.

Current Methods of Material Dispensing

The Manual Method of Material Dispensing

A current manual method for creating a finished product from a formulation in the ink industry is for the operator to physically scoop the material for one of the formulation components from a container, namely a 5 or 3-½ gallon (plastic) bucket or an 8 lb. metal can, and drop it into another container, which is placed on a precision scale, until the operator adds enough material onto the scale to reach the required amount of material called-out in the formulation for that finished product. The operator repeats the process with each component until the operator has "weighed-up" each ingredient. Throughout the process of "weighing-up," the operator may need to manually add to or deduct from the amount of material placed into the finished product container that sits on the scale (referred to as "hand-adds" in the industry) in order to attain the target value stated for each component in the formulation. This manual method of creating finished products from a formulation is referred to as the "Smart Scale" or "Hand Mix" method in a number of industries (hereinafter "Manual Mix Method").

The Automated Method of Material Dispensing

Another current method for creating a finished product from a formulation is through the use of a dispenser that may have a number of reservoir containers, each of which would contain one of the components required to create a finished product. The component is moved from the reservoir container, through the use of a pumping device connected to the reservoir container, through a length of piping to a dispensing valve that, upon receiving feedback from a computer's controlling software (which receives feedback from a scale that the receiving container sits upon), terminates the flow of material (at a value close to the target amount) and deposits the material into a receiving container. The valve would need to repeatedly open and close upon feedback from the computer and scale in order to dispense small amounts of a component to reach the target amount. The pumps subsequently would need to push the component through the valve, which may be rapidly opening and closing. The aforementioned pumping devices typically are piston, positive displacement, gear, diaphragm or peristaltic type pumps that force the material through the piping. Each of the aforementioned pumping device types are best suited for specific applications that relate to, amongst other things, the viscosity of the material being moved, the volume at which the material is required to pass through it and the amount of accuracy required of the pumping device for the application. The aforementioned dispensing valve may be a ball, globe, piston, diaphragm, plug or butterfly type. Each of the aforementioned dispensing valve types are best suited for specific applications that relate to, amongst other things, the viscosity of the material being moved, the volume at which the material is required to pass through it and the amount of accuracy required of the dispensing valve for the application. This automated method of creating finished products from a formulation is often referred to as "Automated Pump Dispensers" method in a number of industries (hereinafter "Gravimetric/Pump Dispenser Method").

Disadvantages of the Current Manual Method of Dispensing Formulations

Operator handling is the most costly expense of creating finished products of ink created by using the Manual Mix Method. In the ink industry, for instance, 5 and 3-½ gallon plastic buckets and 5 lb. and 8 lb. tin buckets are the most common container types used for storage and delivery of ink, whether the material is a base component used to create a finished product or is finished ink. The operator must manually remove the component from the container through the use of a spoon or putty knife type of tool. Paste-type ink, for instance, can be extremely dense and highly viscous (4,000–40,000 cps (centipoise) where water=1 cps; honey =5,000 cps). Paste-type ink's "stringing" characteristics (the ability for the material to adhere to itself, even when attempting to be separated) are high. The process of scooping the material from the buckets is physically taxing on the operator and can be a very messy operation due to the stringing nature of the material. The accuracy of creating a formulation using the Manual Method is a function of the resolution of the scale (how accurate the scale is (measured in a percentage of the scale's full capacity)) and of operator skill in being able to apply the appropriate amount of material needed for any given formulation. If the material is highly viscous the operator can more easily remove material from the amount added (if the amount added were too high) than if the material were less viscous in which case the material added may disperse into the material already in the receiving container, not allowing for removal of the amount over added. If too much of a given material of the formulation is added the other components required for the formulation would proportionally needed to be added to, resulting in the creation of more finished product than originally requested, potentially resulting in material waste.

Disadvantages of the Gravimetric/pump Dispenser Method of Dispensing Formulations Some of the major deficiencies found in the Gravimetric/Pump Dispenser Method are dispense valve actuation, dispensing time, accurate reporting, scale cost, effect of vibration and wind currents, pump wear and cost, air fluctuation, and multiple scale cost.

The dispense valve opens via an electric/pneumatic solenoid valve which is controlled by the HMI. This valve must send a pneumatic (air) signal that must physically travel down an air line in order to open the dispense valve. The delay in air arriving at the pneumatic solenoid affects how fast the dispense valve can physically open and close. The delay will ultimately affect how long the dispense valve remains in the pulse mode. If the target weight amount is less than or equal to 0.1 grams the importance of the dispense valve not remaining in the pulse mode is a critical time variable.

The multiple dispensing valves need to move in and out of position to accommodate any given material needing to be dispensed. There are time additional delays due to the scale needing to completely stop its movement after each dispense in order that the computer can activate the dispense valve to dispense more product, if required. The overall formulation dispense time may therefore increase because of required accuracy or number of components. As the dispense valve opens and closes some amount of residual liquids, in the form of a drop, can remain on the edge of the dispense valve. When the scale signals the computer that the target value has been reached the computer closes the dispense valve. The residual material can fall into the final receiving container due to gravity. The computer receives a signal that the dispense is complete and does not account for any residual material that may fall into the final dispense container. To resolve this inherent problem some manufacturers of Gravimetric/Pump Dispensers may have their software "lock-in" the target value for reporting purposes, when in fact the actual dispensed amount may be different. The scales used with Gravimetric/Pump Dispensers vary in cost between $1,500 and $10,000 per scale. Some Gravimetric/Pump Dispensers may use several scales of varying capacities that add significantly to the cost of the Gravimetric/Pump Dispenser. Scales can be susceptible to vibration and air movement due to their sensitive load cells. Scales used for Dispensers are often set to read as accurately as possible. Air movement over the scale or vibration under the scale may cause the scale to interpret the movement as additional weight and relay the information to the computer. The computer may interpret that the dispense valve has added more material to the final dispense when in fact it has not. The computer, therefore, must give the scale time to stabilize before adding more product. This problem could cause time delays and inaccurate readings of the actual dispense if the scale is not shrouded by a cover. Gravimetric/Pump Dispensers rely on pumps to transfer material from the reservoir containers to the dispense valves. A costly pump is required for each material component. The pumps add considerable upfront expense and ongoing maintenance expenses to the system. The cost of maintenance is high due to the fact that the pumps, being mechanical devices, inherently are subject to a high degree of wear and tear. Failure of the seals that provide the pumping ability is the most common maintenance issue with pumps. The pumping system relies on compressed air supplied by the end user of the Gravimetric/Pump Dispensers. Air compressors struggle with the delivery of consistent air pressure which the dispense valve relies on to accurately dispense to the scale. If there is too much fluctuation in delivered air pressure (15–20 psi) the calibration values set in the computer may "over dispense" or "under dispense."

Disadvantages of Transportation, Storage and Disposal of Current Material Containers

Cost of Residual Waste in Containers at Disposal

There can be a high costs relating to residual waste of material in a container when the material in the container is used and the container is disposed of. Waste is also due to the material curing prior to its intended end use when, in the container, it may develop a film (often referred to as "skinning") when exposed to certain environmental conditions. The operator may dispose of the container even though it may still have a substantial amount of material remaining in it.

Throughout the course of using any material stored in a bucket container, the buckets lid may be removed and replaced a multiple numbers of times, depending on the volume requirement of that particular material for any given formulation. If all of the material in the bucket is not used when the lid is first removed, and the lid is repeatedly removed and replaced, over the course of time the material in the bucket, especially that material that may not have been sufficiently removed from the side walls of the bucket, tends to skin-over or may become crusty, rendering it useless and adding to the amount of wasted material. Occasionally the dried or contaminated material on the sidewalls contaminates the remaining "good" material in the bottom of the bucket, rendering the good material difficult to work with, making it more subject to operator disposal. Additionally, on the bottom of a bucket, due to the buckets' construction, areas could be present where ink becomes trapped and the complete removal of the ink from the bucket becomes virtually impossible.

Throughout the course of using any material stored in a HDPE jug container, the HDPE jug containers' cap may be removed and replaced a multiple numbers of times, depending on the volume requirement of that particular material for any given formulation. If all of the material in the HDPE jug container is not used when the cap is first removed, and the cap is repeatedly removed and replaced, over the course of time the material in the HDPE jug container, especially that material that may not have been sufficiently removed from the side walls of the HDPE jug container, tends to skin-over or may become crusty, rendering it useless and adding to the amount of wasted material. Occasionally the dried or contaminated material on the sidewalls of the HDPE jug container contaminates the remaining "good" material in the bottom of the HDPE jug container, rendering the good material difficult to work with, making it more subject to operator disposal. Additionally, on the bottom and on the sidewalls of an HDPE jug container, due to the HDPE jug container construction and the small opening, areas could be present where ink becomes trapped and the complete removal of the ink from the HDPE jug container becomes virtually impossible.

Cost of Shipping and the Storage of Containers

Buckets, jugs and tubes (cardboard or HDPE cylindrical tubes typically holding 5 or 8 lbs. of finished paste-type ink material, having an orifice molded into a fixed bottom and a movable top "puck") are bulky in their physical characteristics.

Buckets typically have tapered sides, allowing for them to be stacked (or "nested") one inside the other when being stored in their empty state. Jugs and Sonoco tubes cannot be stacked into one another due to their cylindrical size, in either their empty state or their filled state. Both types require a large number of cubic feet to ship and store, both in an empty and in a filled state.

Cost of Disposal

When spent buckets, jugs and tubes are disposed of they often take up the same physical cubic space in a disposal dumpster as they do when in their empty state. The buckets, jugs and tubes may be disposed of after being compacted using a specialized tool which is most often seen only at high volume ink manufacturers or printers.

Recycling and Environmental Issues

Recycling of spent buckets and jugs is limited due to the fact that the materials in the buckets often contaminate the buckets, rendering the recycling option ineffective. Disposal of spent buckets and jugs can require the same physical cubic footage in a landfill as they require in their empty state. Recycling of cardboard tubes is not a viable option due to the fact that the inner lining of the tubes cannot be cleaned enough to guarantee non-contaminated reuse of them.

SUMMARY OF THE INVENTION

The present invention looks to improve on the methodology and apparatus in which materials are dispensed in order to create a desired finished product based on a prescribed mixture of a number of material components typically divided according to their individual requirements by percentages (hereinafter "Formulation Dispenser"). The present invention additionally looks to improve upon the container in which the material is stored, shipped and used, hereinafter "Material Bag."

The present invention is a methodology and apparatus (Formulation Dispenser) comprising a plurality of integral material reservoir cylinders (each of which contains a separate Material Bag in which resides a component required for a formulation), or a plurality of alternate material reservoir containers (typically drums that are detached from and are not part of the preferred embodiment of the Formulation Dispenser and that supply material to the Formulation Dispenser, with a component required for a formulation residing in each drum), or a combination of both a plurality of integral material reservoir cylinders and a plurality of alternate material reservoir containers, that provides a volume of material through a supply tube into a valve that directs the material to either: 1) a dispense tube and through a dispense valve, then into a receiving container that sits upon a scale, or 2) into a dispense cylinder in which resides a piston that, through the use of a piston drive plate actuator and the piston drive plate actuators piston drive plate, moves the piston and directs the material through a valve which directs the material through a dispense tube and in-turn through a dispense valve and into a receiving container that sits upon a scale.

The Preferred and Improved Container

One aspect of the present invention is the preferred and improved container as required for use in the present invention as seen as a Material Bag Assembly in FIG. 2, attached hereto. The preferred and improved container seen in FIG. 2 is material bag 8 comprising a substantially air-tight, flexible, compressible composite selected from among urethane, vinyl laminated fabric, chloroprene, viscoelastic fabric, buna-N, vinyl, cloth inserted rubber, polytetraflouroethane, elastomeric rubber, polypropylene, fluoroelastomers, rubber, hyplon, polyethylene, neoprene, polyvinylchloride, nitrile, ployolefin films, nylon, prismatic films, lycra, polyurethane, and the like. The preferred material is polyethylene. Bag 8 has a top, bottom and sides, sealed airtight, and also has a centered opening adjacent to the top in the form of a hole large enough to accept the clear passage of a molded fitting (hereinafter referred to as a "bag spout 9") secured into it, becoming an integral part of the material bag 8. Bag spout 9 provides for: 1) an opening in which to fill the material bag 8 with material, 2) an opening in which to evacuate the material bag 8 of material, and 3) a means of connecting material bag 8 to the Formulation Dispenser. Material bag 8 may have a delta seal 8B (a sealed-tight seam on a angle to its starting point) on any one its four corners, each of which may decrease the opportunity for material to become trapped within that area and which directs material in the direction of bag spout 9 throughout the process of evacuation of material from material bag 8 when pressure is applied to material bag 8.

Uses of the Preferred and Improved Formulation Dispenser

A) One use of the preferred Formulation dispenser may he when the end-user of the Formulation Dispenser requires the Formulation Dispenser to provide large quantities of finished product to satisfy any given project requirements and to create the finished product in a commercially acceptable timeframe. For example, in the ink industry a printer may need to create enough of a custom color (i.e. 50.00 lbs. of finished product) to produce 100,000 sheets of finished printed pages. The formulation may require a majority of the finished product to be made from one or more of the components in the formulation (e.g., 90% of the finished product being made from two components). The end-user may require the Formulation Dispenser to provide a high-speed, high-flow dispensing manner for any of the components to create the finished product (hereinafter referred to as a "coarse fill method").

As a part of the present invention expressed in the following description, including its preferred and improved methodology, and as referenced in illustration FIG. 1 attached hereto, the coarse-fill method of using the Formulation Dispenser would most preferably use a combination of: 1) a plurality of detached alternate drum material reservoirs each having a single drum pump attached and each of which supplies a component to a preferred or to an alternate valve, and thereafter through the preferred embodiments of the Formulation Dispenser as described below, and 2) a plurality of integral material reservoirs which uses a component source in the form of a material bag to supply material to a preferred or to an alternate valve, and thereafter through the embodiments of the Formulation Dispenser as described below.

If the formulation requires a coarse fill method for any of the given components, the Formulation Dispenser would initially dispense material using the coarse fill method to an amount approximately 1 lb. from the total target amount for that component. The remaining amount of component needed to attain the total amount required by the formulation for that component would be dispensed through the precision metering cylinder manner of dispensing (hereinafter referred to as a "small quantity method").

The preferred Formulation Dispenser contains a substantially identical plurality of preferred assemblies, each of which contains one of a number of components used to create a finished product. Each preferred assembly would have preferred embodiments and would work in the manner as described below. The preferred embodiment(s) of the invention are described in each figure as follows.

Figure 1:
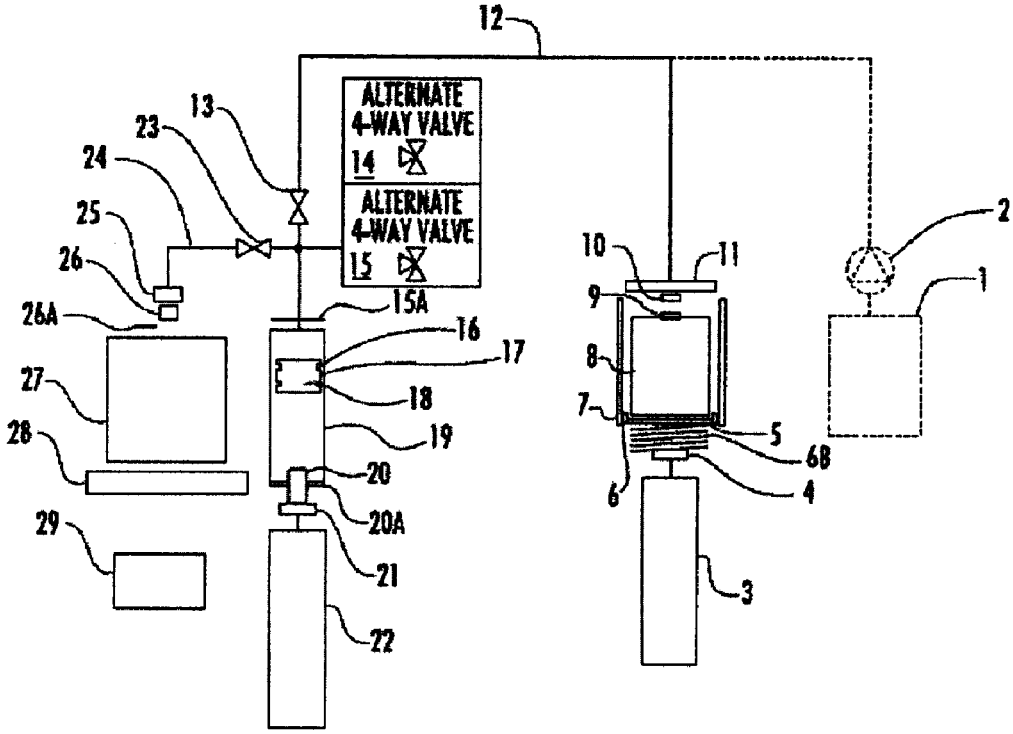
FIG. 1 is a schematic diagram of a single component assembly of the preferred Formulation Dispenser.
Figure 2A:
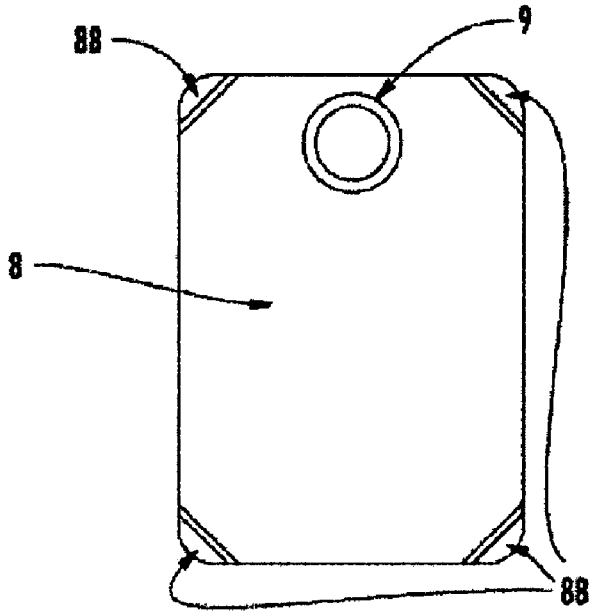
FIG. 2 is a schematic diagram of the preferred Material Bag Assembly.
Figure 2B:
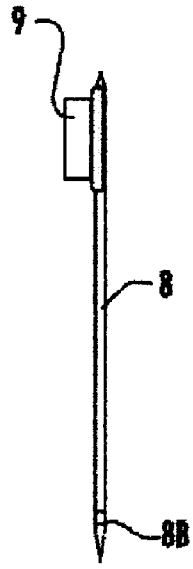
Figure 3:
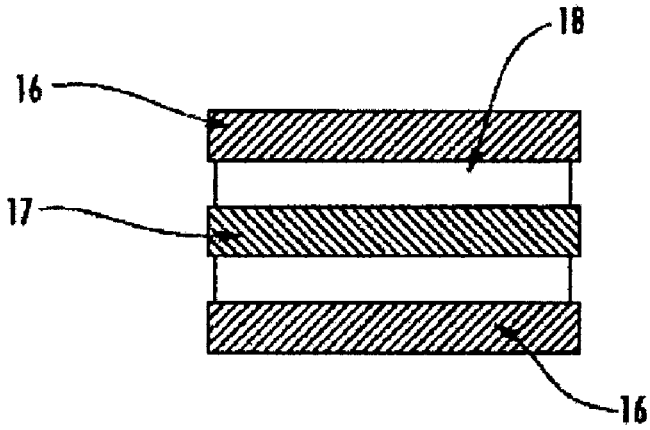
FIG. 3 is a schematic diagram of the preferred Piston Assembly.
Figure 4:
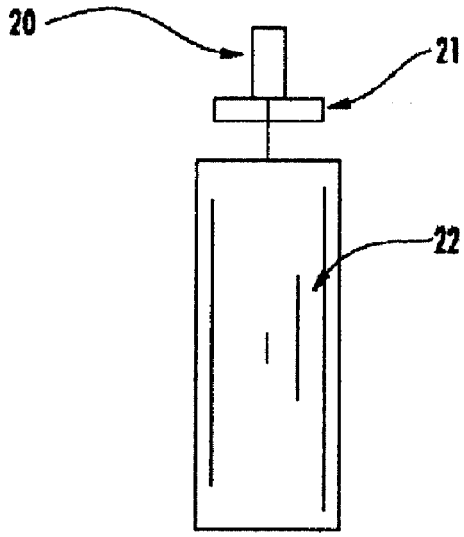
FIG. 4 is a schematic diagram of the preferred Piston Linear Actuator Assembly.

1) HMI 29 sends a signal to either detached drum pump 2 or to bag linear actuator 3, depending upon the volume and speed requirements of the component for the formulation.
2) For formulations requiring the coarse fill method of dispensing for any component HMI 29 would signal supply valve 13 to open entirely and would signal dispense valve 23 to open entirely and would signal detached drum pump 2 to start. Detached drum pump 2 would move the component from alternate material reservoir 1 through supply tube 12, through supply valve 13, through dispense tube connecting plate 15A, into dispense cylinder 19, through dispense valve 23, through dispense tube 24, through dispense valve housing 25 and, in having developed enough pressure throughout the embodiments described above, would cause proportional dispense valve 26 to open rollingly and material would pass through proportional dispense valve 26, would pass through material sensor 26A (a device used to detect the presence of a solid volume of material, which may be of video or beam-type) and into receiving container 27 which sits upon scale 28.
3) The piston assembly (as seen as an assembly in FIG. 3 and as seen as individual embodiments in FIG. 1) comprised of piston body 18 which may be formed in a manner to provide for a means of maintaining perpendicularity of the bottom of the piston body to the inside walls of dispense cylinder 19 through the use of a number of piston alignment rings 17 of varying dimension located between the piston seals 16 and a number of (most preferable two) piston seals 16, that reside within dispense cylinder 19, and could, as an entire assembly, freely move upwards in direction or freely move downwards in direction within dispense cylinder 19. The piston assembly (FIG. 3) is prevented from passing through the bottom of dispense cylinder 19 (as seen as being towards the direction of the bottom of FIG. 1) through the use of piston stop ring 20A (as shown in FIG. 1). The piston assembly (FIG. 3) is prevented from passing through the top of dispense cylinder 19 (as seen as being towards the direction of the top of FIG. 1) through the use of dispense tube connecting plate 15A (as shown in FIG. 1).
4) The piston assembly (FIG. 3) may move downwards in direction within dispense cylinder 19 due to piston body 18 having pressure exerted onto the top of it by the component when the component is moved: 1) from alternate material reservoir 1 through the use of detached drum pump 2, or 2) from material bag 8 through the use of bag linear actuator 3. Either source of material may cause the voided area created above the piston assembly caused by the downwards movement of the piston assembly in dispenser cylinder 19 to fill with material. In either case, the filling of the void above the piston assembly and the downwards movement of the piston assembly may be assisted by the piston body 18, when piston body 18 has piston gripper 20 (of which the preferred embodiment would be piston gripper 20 which has a bladder, which, when expanded with air, firmly attaches itself to the void inside of piston body 18) firmly attached to it and when piston assembly is drawn in a downwards direction by piston linear actuator 22. The downwards movement of the piston assembly may create a vacuum inside dispense cylinder 19 above piston body 18 and may assist in filling of the void created inside dispense cylinder 19 above piston body 18. Piston alignment rings 17 would assure that piston body 18 travels in a parallel linear motion to dispense cylinder 19 sidewalls. Piston seals 16 would provide for a substantially leak-free contact between piston body 18 and the interior cylinder walls of dispense cylinder 19. Piston seals 16 would prevent the component from bypassing piston body 18 and would cause the component to remain in the area of dispense cylinder 19 above piston body 18.
5) Two alternative embodiments to supply valve 13 and dispense valve 23 would be: 1) an alternate 4-way valve 14, or 2) an alternate 3-way valve 15. With either alternate embodiment to preferred supply valve 13 and preferred dispense valve 23, detached drum pump 2 would move its component from alternate material reservoir 1 through supply tube 12 and through either: 1) alternate 4-way valve 14 which would, upon receiving a signal from HMI 29, switch alternate 4-way valve 14 to direct the component to either: a) pass through dispense tube connecting plate 15A into dispense cylinder 19 (when the small quantity method of dispensing is required to complete the component requirement of a formulation), or b) through dispense tube 24 and onwards through other preferred embodiments as described above (when the coarse-fill method of dispensing is required to satisfy a user requirement) or 2) alternate 3-way valve 15 which would, upon receiving a signal from HMI 29, switch alternate 3-way valve 15 to direct the component through dispense tube connecting plate 15A and into dispense cylinder 19.
6) When HMI 29 receives a signal from scale 28 that the target value for the component (that uses the coarse fill method of dispensing) has been attained HMI 29 signals detached drum pump 2 to stop.
7) HMI 29 would signal supply valve 13 to close, or would signal alternate 4-way valve 14 or alternate 3-way valve 15 to switch to direct material from dispense cylinder 19 to the direction of dispense tube 24, and would signal piston linear actuator assembly (as seen as an assembly in FIG. 4 and as seen as individual embodiments in FIG. 2) to move piston drive plate 21 (which has piston gripper 20 firmly attached to it) upwards to locate and come into positive contact with piston body 18.
8) HMI 29 would signal piston linear actuator assembly to move piston drive plate 21 upwards a defined distance (which defined distance is equal to the amount of incremental movement of piston body 18 upwards that would result in an amount of component being evacuated from that amount of material residing above piston body 18 and in dispense tube 24) that would equal some percentage of the component amount (as being an amount identified by HMI 29 and transmitted to scale 28) required to equal the total target amount required of that component for the formulation, minus the amount previously dispensed of that component (in the coarse-fill manner described above). Depending upon the allowable percentage of error (hereinafter referred to as "tolerance") that any particular component may have (of which each tolerance value is related to the target amount of the required component) HMI 29 may require Formulation Dispenser to dispense component to an amount that is less than the overall required amount of the component. This process of dispensing an amount that is "short" of the required amount continues until the target value has been attained. The upwards movement of piston body 18 would cause component to move through dispense valve 23, through dispense tube 24, through dispense valve housing 25 and, in having developed enough pressure throughout the embodiments described above, would cause proportional dispense valve 26 to open rollingly and component would pass through proportional dispense valve 26, would pass through material sensor 26A and into receiving container 27 which sits upon scale 28.

9) The speed at which piston linear actuator 22 moves upwards or downwards, and resultantly moves piston body 18 to dispel or fill material into or out of dispense cylinder 19, may be the same for all component assemblies of the preferred embodiment, but most preferably the speed would be able to be limited and controlled on a per component assembly basis as a function of the viscosity and rheological properties of the material and by the amount of material needing to be displaced.

10) Upon reaching the target weight required of the component for the formulation, scale 28 would send a signal to HMI 29 which would cause the piston linear actuator assembly to stop the upwards movement of piston drive plate 21. HMI 29 would command piston gripper 20 to positively affix itself to piston body 18. HMI 29 would command piston linear actuator 22 to reverse its direction and move downwards a defined distance. The defined distance of downward movement of piston drive plate 21 is equal to the distance required to decrease the amount of pressure created throughout the embodiments due to the process of dispensing which would result in enough reduction in pressure to cause proportional dispense valve 26 to close.

11) Each proportional dispense valve 26, of which a single proportional dispense valve 26 is illustrated in attached FIG. E, is most preferably a pressure responsive one-way valve of an elastomeric material that resides and is held fast in dispense valve housing 25. Proportional dispense valve 26 opens when the force and pressure of material on it forces it open, and closes effectively and most preferably completely when the force and pressure exerted drops. Elastomeric valves which open and close in response to predetermined discharge force are preferred. Silicone is the preferred material used for elastomeric valves. Proportional dispense valve 26 (as seen in FIG. E) include valve heads 30 that shift outward (as seen as being towards the direction of the bottom of FIG. E) to cause a connector sleeve 31 to double over and extend rollingly, to thereby apply a pressure to the valve head 30 which assists in opening the valve orifice 32. On release of pressure, valve orifice 32 closes and the valve head 30 shifts to a retracted position. Suitable valves are made by Liquid Molding Systems, Inc. under the trademark Sure-Flo, and U.S. Pat. No. Nos. 5,439,143 issued Aug. 8, 1995, 5,339,995 issued Aug. 23, 1994, and 5,213,236 issued May 25, 1993 are understood to describe these valves. The identified patents are incorporated by reference. Dispense valve housing 25 may have a means of preventing valve orifice 32 from extending beyond its normally closed position thereby prohibiting air from entering into the area above dispense valve 26. Dispense valve housing 25 utilizing such a means would result in creation of a "one-way" valve, thus allowing material to pass through dispense valve 26 in only one direction.

B) Another use of the preferred Formulation Dispenser may be when the end-user of the Formulation Dispenser requires the Formulation Dispenser to provide small quantities of finished product to satisfy any given project requirements and to create the finished product in a commercially acceptable timeframe. For example, in the ink industry a printer may need to create enough of a custom color (i.e. 10.00 lbs. of finished product) to produce 10,000 sheets of finished printed pages. The end-user may require the Formulation Dispenser to provide a small-volume of finished product using the small quantity method.

As a part of the present invention expressed in the following description, including its preferred and improved methodology, and as referenced in illustration FIG. 1 attached hereto, the small quantity method of using the Formulation Dispenser would most preferably use a plurality of integral material reservoirs which use a component source in the form of the previously described material bag to supply material to a preferred or to an alternate valve, and thereafter through the preferred dispenser embodiments as described below.

1) The operator inserts material bag 8 (as in FIG. 1) (which is pre-filled by the ink manufacturer with a material as required by the formulation being created) into the bag reservoir 7. HMI 29 sends a signal to bag linear actuator 3 (or any other device capable of exerting enough pressure on preferred material container (preferred material bag 8 described above)) to be able to force the component residing in the preferred material container through the other preferred embodiments as illustrated in FIG. 1.

2) For formulations requiring the small volume method of dispensing for any formulation, HMI 29 would signal supply valve 13 to open entirely and would signal dispense valve 23 to open entirely and would signal bag linear actuator 3 to start. Bag linear actuator 3 would move bag drive plate 4 upwards to locate and come into positive contact with bag plate 5 which in turn would press upwards and would move its component from material bag 3 through supply tube 12, through supply valve 13, through dispense tube connecting plate 15A, into dispense cylinder 19, through dispense valve 23, through dispense tube 24, through dispense valve housing 25 and, in having developed enough pressure throughout the embodiments described above, would cause proportional dispense valve 26 to open rollingly and material would pass through proportional dispense valve 26, would pass through material sensor 26A (a device used to detect the presence of a solid volume of material, which may be of video or beam-type) and into receiving container 27 which sits upon scale 28.

3) Preferred container material bag 5 would have spout clamp 7 (a spring-release clamp device that securely affixes the material bag 8 to the cylinder material reservoir cover 8, assuring a leak-free connection) affixed to bag spout 9. Cylinder material reservoir cover 11 becomes firmly attached to the Formulation Dispenser and provides for a positive connecting point between bag reservoir 7 and tube supply 12. Bag overlap seal 6, being firmly attached to bag plate 5, extends outwards beyond the diameter of bag plate 5 and is made from an elastomeric material, of which polyester is the most preferred, and comes in positive radial contact with the inside walls of bag reservoir 7 (most preferable tubular polyvinyl chloride, open at both ends, which is integrated into the Formulation Dispenser and which receives and contains material bag 8) and prevents material bag 8 from bypassing bag plate 5 when pressure is exerted on bag plate 5 from bag drive plate 4 (which is driven by bag linear actuator 3).

4) When material in material bag 8 is fully expelled and when material bag 8 needs to be replaced the operator removes cylinder material reservoir cover 11 from the Formulation Dispenser, releases spout clamp 10 from cylinder material reservoir cover 11 and from expelled material bag 8, inserts replacement (filled) material bag 8 into bag reservoir 7, connects spout clamp 10 to bag spout 9 and to cylinder material reservoir 11 and attaches cylinder material reservoir 11 to Formulation Dispenser. When a replacement material bag 8 is placed in bag reservoir 7 Spring 6B, residing inside bag reservoir 7 and under bag plate 5, is open throughout its center to allow for free passage of bag drive plate 4 through its open center. Spring 6B presses upon the underside of bag plate 5 and resultantly presses filled material bag 8 upwards in bag reservoir 7 to prevent stress from exerting on bag spout 9 when filled material bag 8 is inserted in bag reservoir 7.

5) The piston assembly (as seen as an assembly in FIG. 3 and as seen as individual embodiments in FIG. 1) comprised of piston body 18 which may be formed in a manner to provide for a means of maintaining perpendicularity of the bottom of the piston body to the inside walls of dispense cylinder 19 through the use of a number of piston alignment rings 17 of varying dimension located between the piston seals 16 and a number of (most preferable two) piston seals 16 that reside within dispense cylinder 19, and could, as an entire assembly, freely move upwards or freely move downwards in direction within dispense cylinder 19. The piston assembly (FIG. 3) is prevented from passing through the bottom of dispense cylinder 19 (as seen as being towards the direction of the bottom of FIG. 1) through the use of piston stop ring 20A (as shown in FIG. 1). The piston assembly (FIG. 3) is prevented from passing through the top of dispense cylinder 19 (as seen as being towards the direction of the top of FIG. 1) through the use of dispense tube connecting plate 15A (as shown in FIG. 1).

6) The piston assembly (FIG. 3) may move downwards in direction within dispense cylinder 19 due to piston body 18 having pressure exerted onto the top of it by the component when the component is moved: 1) from alternate material reservoir 1 through the use of detached drum pump 2, or 2) from material bag 8 through the use of bag linear actuator 3. Either source of material may cause the voided area created above the piston assembly caused by the downwards movement of the piston assembly in dispense cylinder 19 to fill with material. In either case, the filling of the void above the piston assembly and the downwards movement of the piston assembly may be assisted by the piston body 18, when piston body 18 has piston gripper 20 firmly attached to it and when the piston assembly is drawn in a downwards direction by piston linear actuator 22. The downwards movement of the piston assembly may create a vacuum inside dispense cylinder 19 above piston body 18 and may assist in filling of:the void created inside dispense cylinder 19 above piston body 18. Piston alignment rings 17 would assure that piston body 18 travels in a parallel linear motion to dispense cylinder 19 sidewalls. Piston seals 16 would provide for a substantially leak-free contact between piston body 18 and the interior cylinder walls of dispense cylinder 19. Piston seals 16 would prevent the component from bypassing piston body 18 and would cause to have component remain in the area of dispense cylinder 19 above piston body 18.

7) Two alternative embodiments to supply valve 13 and dispense valve 23 would be: 1) alternate 4-way valve 14, or 2) alternate 3-way valve 15. With either alternate embodiment to preferred supply valve 13 and preferred dispense valve 23, bag linear actuator 3 would move bag drive plate 4 upward to locate and come into positive contact with bag plate 5 which in turn would press upwards and would move the component from material bag 3 through supply tube 12 and through either: 1) alternate 4-way valve 14 which would, upon receiving a signal from HMI 29, switch alternate 4-way valve 14 to direct the component to either: a) pass through dispense tube connecting plate 15A into dispense cylinder 19 (when the small quantity method of dispensing is required to complete the component requirement of a formulation), or b) through dispense tube 24 and onwards through other preferred embodiments as described above or 2) alternate 3-way valve 15 which would, upon receiving a signal from HMI 29, switch alternate 3-way valve 15 to direct the component through dispense tube connecting plate 15A and into dispense cylinder 19.

8) When HMI 29 receives a signal from scale 28 that the target value for the component (that uses the small volume method of dispensing) has been attained HMI 29 signals bag linear actuator 3 to stop.

9) HMI 29 would signal supply valve 13 to close, or would signal alternate 4-way valve 14 or alternate 3-way valve 15 to switch to direct material from dispense cylinder 19 to the direction of dispense tube 24, and would signal piston linear actuator assembly (as seen as an assembly in FIG. 4 and as seen as individual embodiments in FIG. 2) :to move piston drive plate 21 (which has piston gripper 20 firmly attached to it) upward to locate and come into positive contact with piston body 18.

10) HMI 29 would signal piston linear actuator assembly to move piston drive plate 21 upward a defined distance (which defined distance is equal to the amount of incremental movement of piston body 18 upward that would result in an amount of component being evacuated (from that amount of material residing above piston body 18 and in dispense tube 24)) that would equal the component amount (as being an amount identified by HMI 29 and transmitted to scale 28) required to equal the total target amount required of that component for the formulation, minus the amount previously dispensed of that component in the dispense manner bypassing dispense cylinder 19 described above). Depending upon the allowable percentage of error (hereinafter referred to as "tolerance") that any particular component may have (of which each tolerance value is related to the target amount of the required component) HMI 29 may require Formulation Dispenser to dispense component to an amount that is less than the overall required amount of the component. This process of dispensing an amount that is "short" of the required amount continues until the target value has been attained. The upwards movement of piston body 18 would cause component to move through dispense valve 23, through dispense tube 24, through dispense valve housing 25 and, in having developed enough pressure throughout the embodiments described above, would cause proportional dispense valve 26 to open rollingly and component would pass through proportional dispense valve 26, would pass through material sensor 26A and into receiving container 27 which sits upon scale 28.

11) The speed at which piston linear actuator 22 moves upwards or downwards, and resultantly moves piston body 18 to dispel or fill material into or out of dispense cylinder 19, may be the same for all component assemblies of the preferred embodiment, but most preferably the speed would be able to be limited and controlled on a per component assembly basis as a function of the viscosity and Theological properties of the material and by the amount of material needing to be displaced.

12) Upon reaching or not reaching the target weight required of the component for the formulation, HMI 29 would receive a reading from scale 28 and would determine whether to stop or not to stop the upwards movement piston linear actuator 22 and its attached piston drive plate 21. If the target value for the component was attained HMI 29 would command piston gripper 20 to positively affix itself to piston body 18. HMI 29 would command piston linear actuator 22 to reverse its direction and move downwards a defined distance. The defined distance of downward movement of piston drive plate 21 is equal to the distance required to decrease the amount of pressure created throughout the embodiments described above due to the process of dispensing. The pressure throughout the embodiments would be reduced to an amount equal zero, or to an amount of pressure less that zero, whichever is required to provide enough pressure in the reverse manner to cause proportional dispense valve 26 to close.

Figure 5:
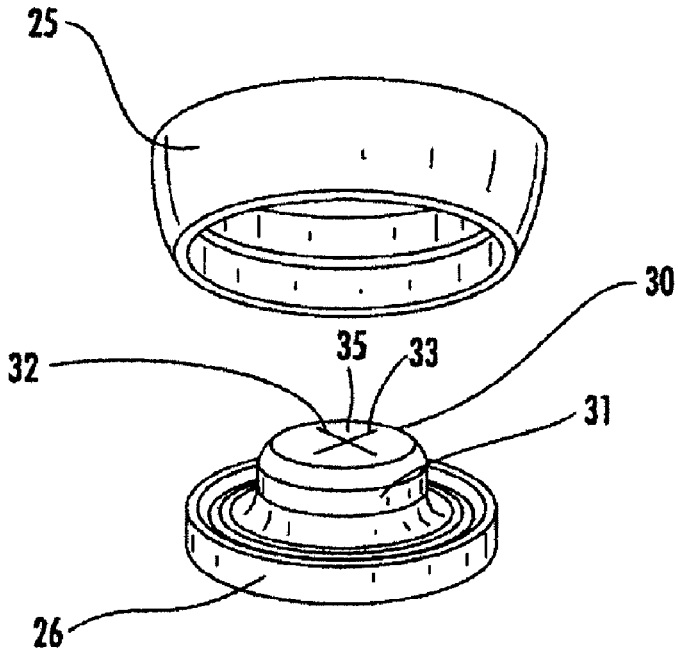
FIG. 5 is a schematic diagram of the preferred Proportional Dispense Valve Assembly.

13) Each proportional dispense valve 26, of which a single proportional dispense valve 26 is illustrated in attached FIG. 5, is most preferably a pressure responsive one-way valve of an elastomeric material that resides and is held fast in dispense valve housing 25. Proportional dispense valve 26 opens when the force and pressure of material on it forces it open, and closes effectively and most preferably completely when the force and pressure exerted drops.

Elastomeric valves which open and close in response to predetermined discharge force are preferred. Silicone is the preferred material used for elastomeric valves. Proportional dispense valve 26 (as seen in FIG. 5) include valve heads 30 that shift outward (as seen as being towards the direction of the bottom of FIG. 5) to cause a connector sleeve 31 to double over and extend rollingly, to thereby apply a pressure to the valve head 30 which assists in opening the valve orifice 32. On release of pressure, valve orifice 32 closes and the valve head 30 shifts to a retracted position. Suitable valves are made by Liquid Molding Systems, Inc. under the trademark SureFlo, and U.S. Pat. No. Nos. 5,439,143 issued Aug. 8, 1995, 5,339,995 issued Aug. 23, 1994, and 5,213,236 issued May 25, 1993 are understood to describe these valves. The identified patents are incorporated by reference.

ADVANTAGED OF THE PRESENT INVENTION AND ITS PREFERRED AND IMPROVED CONTAINER

Our method of dispensing custom formulations provides a more cost effective means of creating custom formulations in a more timely manner.

Decreased Operator Handling

Our method reduces operator handling due to the fact that the operator doesn't need to scoop the paste-type ink from a bucket. The operator may need to physically scoop fractional amounts of ink (referred to in the industry as "hand adds") when adjusting the quantity of ink in the formulation container to arrive at the target weight. The bag, with its preferred pressure-sensitive proportional valve attached, cleanly cuts the ink and does not requiring operator handling.

Reduced Waste

An operator can minimize the wasted material through accurate operation of the present invention. Residual material waste is limited to the amount of material remaining in the spent bag.

Reduced Shipping and Storage

Shipping and storage costs are decreased with the present invention due to bag light weight and compact empty state, saving in both shipping weight costs and required facility storage space for both filled and empty containers.

Reduced Cost of Disposal

The cubic inches required for disposal of a spent bag is decreased with the current invention and is significantly smaller than any of the current material containers used.

Reduced Environmental Impact at Disposal

The bag uses $1/12^{th}$ the amount of plastic in its construction as compared to a typical plastic bucket handling a similar amount of material. Using the bag as a storage and dispensing container there will be less of an impact on the environment at disposal.

Definitions

"Material"–a flowable, non-solid substance, such as liquid, paste or powder.

"Component"–a material that is used in some proportion to create a finished product utilizing a single assembly of the plurality of assemblies as found on the Formulation Dispenser.

"Formulation"–a prescribed recipe of a number of material components typically divided, according to their individual requirements, by percentages that, when dispersed or thoroughly mixed together, create a desired finished product.

"Container"–device in which materials are packaged into, stored in or used as delivery package.

"Dispenser"–equipment with some level of automation which provides for dosing of components to a prescribed amount and deposits them into a container "Formulation Dispenser"–the most preferred assembly of parts that when used create a formulation.

"Finished Product"–the fully dispersed components of a formulation.

"HMI"–Human/Machine Interface–a set of devices that allow for an interface between those devices and humans for the control of equipment or processes of equipment (i.e. computers, program logic controllers, etc.).

"Downwards"–as seen as being towards the direction of the bottom of FIG. 1 attached hereto.

"Upwards"–as seen as being towards the direction of the top of FIG. 1 attached hereto.

What is claimed is:

1. A formulation dispenser for dispensing a material, the material including either of a liquid or paste, comprising:

at least one material reservoir cylinder for containing the material;

a pressure responsive valve in fluid communication with the at least one material reservoir cylinder;

a human/machine interface controlling the dispensing of material through the valve;

said valve directing material from the cylinder to a receiving container;

a sensor for detecting the presence of material dispensing into the receiving container and for communicating with the human/machine interface.

2. A formulation dispenser as in claim 1 further comprising:

a plurality of material reservoir cylinders each for containing a material.

3. A formulation dispenser as in claim 1 further comprising: an alternate material reservoir container.

4. A formulation dispenser as in claim 1, further comprising a scale for weighing material dispensed into the receiving container.

5. A formulation dispenser as in claim 1 wherein the pressure responsive dispense valve for controlling the amount of material dispensed into the receiving container includes a valve head and a connector sleeve that may double over and cause a valve orifice on the valve head to open.

6. A formulation dispenser as in claim 5, further comprising a piston to direct material through the cylinder and through the dispense valve.

7. A method of dispensing to create a formulation, utilizing at least one material reservoir cylinder for containing a material, and a pressure responsive valve in fluid communication with the reservoir cylinder, comprising:

utilizing the valve to direct material from the cylinder to a receiving container;

utilizing a sensor to detect the presence of material directed to the receiving container;

weighing the material dispensed in the receiving container; and dispensing relatively small amounts of material into the receiving container until a target weight has been reached.

8. A formulation dispenser as in claim 2 wherein the at least one of the plurality of material reservoir cylinders contains:

a compressible material bag with an opening and at least one corner, the at least one corner defining a delta seal; and a bag spout sized to fit to the opening.

9. A formulation dispenser comprising:

at least one material container for containing material to be dispensed, a pressure responsive valve that will open rollingly to control the flow of material to be dispensed, and a sensor for detecting the presence of material discharged through the pressure responsive valve and for communicating with a human/machine interface which further controls additional amount of material to be dispensed through the valve.

10. The formulation dispenser of claim 9 further comprising:

a receiving container, and a scale for detecting the amount of material discharged through the pressure responsive valve.

11. The formulation dispenser of claim 9 wherein the human/machine interface is a computer.

12. The formulation dispenser of claim 9 wherein the material container further includes a material bag.

13. The formulation dispenser of claim 9 further comprising a piston for pushing material to be dispensed.

14. A formulation dispenser comprising:

at least one material container for containing material to be dispensed, a pressure responsive valve that will open rollingly to control the flow of material to be dispensed, and will close to cut the material to be dispensed;

a sensor for detecting the presence of material discharged through the pressure responsive valve; and a scale for detecting the amount of material discharged through the pressure responsive valve and for communicating with a human/machine interface which further controls additional amount of material to be dispensed through the valve.

15. The formulation dispenser of claim 14 further comprising:

a receiving container valve.

16. The formulation dispenser of claim 15 wherein the human/machine interface is a computer.

17. The formulation dispenser of claim 14 wherein the material container further includes a material bag.

18. The formulation dispenser of claim 16 further comprising an actuator for pushing material to be dispensed.

19. A formulation dispenser for dispensing material, the dispenser comprising a dispenser cylinder and a piston body for controlling the dispensing of material through a pressure responsive valve that will open rollingly upon the application of pressure exerted by the piston body on the material to be dispensed, the valve controlling the flow of material to be dispensed, and the valve closing upon the reduction of pressure exerted on the material and cutting the material.

20. The formulation dispenser of claim 19 further comprising an actuator for exerting pressure on the piston body.

21. The formulation dispenser of claim 1 wherein the sensor is either a video or beam-type sensor.

22. The formulation dispenser of claim 20 further comprising a human/machine interface for controlling the actuator.

23. The formulation dispenser of claim 22 further comprising a sensor for detecting the presence of material discharged through the pressure responsive valve.

24. The formulation dispenser of claim 23 further comprising a scale for weighing material dispensed through the pressure responsive valve.

* * * * *